US008800768B2

(12) United States Patent
Corbat et al.

(10) Patent No.: US 8,800,768 B2
(45) Date of Patent: Aug. 12, 2014

(54) CLAMSHELL PACKAGING

(71) Applicant: Milwaukee Electric Tool Corporation, Brookfield, WI (US)

(72) Inventors: Jeffrey Corbat, Racine, WI (US); Wai Tat Choi, Hong Kong (HK)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 13/907,270

(22) Filed: May 31, 2013

(65) Prior Publication Data

US 2013/0319896 A1 Dec. 5, 2013

Related U.S. Application Data

(60) Provisional application No. 61/653,868, filed on May 31, 2012.

(51) Int. Cl.
*B65D 75/32* (2006.01)
*B65D 73/00* (2006.01)

(52) U.S. Cl.
CPC ..... *B65D 75/322* (2013.01); *B65D 73/0092* (2013.01)
USPC ..... 206/470; 206/463

(58) Field of Classification Search
USPC ..... 206/463, 776, 462, 470, 471, 461, 779, 206/780, 775, 777, 782; 493/114, 84
See application file for complete search history.

(56) References Cited

U.S. PATENT DOCUMENTS

| | | | | |
|---|---|---|---|---|
| 2,850,160 | A | | 9/1958 | Siebel et al. |
| 2,945,586 | A | * | 7/1960 | Mackes ..... 206/470 |
| 3,127,993 | A | | 4/1964 | Phipps |
| 3,173,540 | A | | 3/1965 | Lapides |
| 3,192,681 | A | | 7/1965 | Greenbaum |
| 3,303,930 | A | | 2/1967 | Hyland |
| 3,314,535 | A | | 4/1967 | Jarecki |
| 3,406,492 | A | | 10/1968 | Ludwig |
| 3,407,928 | A | | 10/1968 | Watts, Jr. |
| 3,486,615 | A | | 12/1969 | Woskin |
| 3,657,857 | A | | 4/1972 | De Woskin et al. |
| 3,664,085 | A | | 5/1972 | Rousseau et al. |
| 4,083,451 | A | | 4/1978 | Hair |
| 4,091,927 | A | | 5/1978 | Lunsford |
| 4,202,464 | A | | 5/1980 | Mohs et al. |
| 4,225,077 | A | | 9/1980 | Veitinger |
| 4,261,462 | A | | 4/1981 | Wysocki |
| 4,437,566 | A | | 3/1984 | Szahler |
| 4,456,122 | A | | 6/1984 | Kalal |
| 4,496,052 | A | | 1/1985 | Nertman |

(Continued)

*Primary Examiner* — Steven A. Reynolds
(74) *Attorney, Agent, or Firm* — Michael Best & Friedrich LLP

(57) ABSTRACT

A clamshell package includes a first clamshell portion having a first surface with a first edge, and a first chamber portion. A second clamshell portion is coupled to the first clamshell portion about a fold axis. The second clamshell portion has a second surface with a second edge, and a second chamber portion. A paper card includes a first card portion, a second card portion, and a connecting portion connecting the first card portion and the second card portion. The first card portion is coupled to the first surface. The second portion is coupled to the second surface. The first edge and second edge extend beyond a perimeter of the paper card. A hanging hole extends through the first clamshell portion, the second clamshell portion, and the paper card.

20 Claims, 5 Drawing Sheets

(56) References Cited

U.S. PATENT DOCUMENTS

| | | | | |
|---|---|---|---|---|
| 4,512,474 | A | 4/1985 | Harding | |
| D278,979 | S | 5/1985 | Anderson et al. | |
| 4,574,951 | A | 3/1986 | Weaver | |
| 4,739,883 | A | 4/1988 | Mohs et al. | |
| 4,779,734 | A | 10/1988 | Kydonieus | |
| 4,896,770 | A | 1/1990 | Calcerano et al. | |
| 4,993,583 | A | 2/1991 | Chasen | |
| 5,090,570 | A | 2/1992 | Todd | |
| D327,426 | S | 6/1992 | Karita et al. | |
| 5,129,516 | A | 7/1992 | Theros | |
| 5,143,215 | A | 9/1992 | Hartley et al. | |
| 5,209,354 | A | 5/1993 | Thornhill et al. | |
| 5,297,679 | A | 3/1994 | Rondone et al. | |
| 5,586,657 | A | 12/1996 | Ward et al. | |
| 5,791,474 | A | 8/1998 | Hansen | |
| 5,863,414 | A | 1/1999 | Tilton | |
| 6,011,472 | A | 1/2000 | Pendergraph et al. | |
| 6,016,913 | A | 1/2000 | Tilton | |
| 6,053,321 | A | 4/2000 | Kayser | |
| 6,065,589 | A * | 5/2000 | Ouwens | 206/6.1 |
| D427,900 | S | 7/2000 | O'Malley et al. | |
| 6,155,414 | A | 12/2000 | Vaessen | |
| 6,161,693 | A | 12/2000 | Findle et al. | |
| 6,170,663 | B1 * | 1/2001 | Glassman | 206/461 |
| D441,646 | S | 5/2001 | Adkins | |
| 6,308,832 | B1 | 10/2001 | Pirro et al. | |
| 6,330,945 | B1 * | 12/2001 | Reimer | 206/470 |
| 6,364,114 | B1 * | 4/2002 | Glassman | 206/469 |
| D458,125 | S | 6/2002 | Tachikawa et al. | |
| 6,401,921 | B1 | 6/2002 | Usami | |
| 6,719,139 | B1 * | 4/2004 | Foos et al. | 206/462 |
| D489,253 | S | 5/2004 | Kumakura et al. | |
| 6,729,468 | B1 * | 5/2004 | Dobmeier | 206/303 |
| D497,547 | S | 10/2004 | Kumakura et al. | |
| 7,021,458 | B2 * | 4/2006 | Cummings | 206/77.1 |
| D532,688 | S | 11/2006 | Manuel et al. | |
| D534,795 | S | 1/2007 | Manuel et al. | |
| 7,204,367 | B2 * | 4/2007 | Bott et al. | 206/219 |
| 7,281,630 | B2 * | 10/2007 | Hartman et al. | 206/467 |
| 7,322,473 | B2 | 1/2008 | Fux | |
| 7,404,487 | B2 | 7/2008 | Kumakura et al. | |
| 7,448,496 | B2 | 11/2008 | Williams-Hartman | |
| 7,556,152 | B2 * | 7/2009 | Lechelle | 206/581 |
| 7,621,405 | B2 * | 11/2009 | Schweitzer et al. | 206/703 |
| 7,623,040 | B1 | 11/2009 | Cote | |
| 7,624,859 | B1 * | 12/2009 | Casanova et al. | 206/45.24 |
| 7,726,480 | B2 | 6/2010 | Nazari | |
| 7,753,205 | B2 | 7/2010 | Shibata et al. | |
| 8,069,983 | B2 * | 12/2011 | Cross | 206/349 |
| 8,146,745 | B2 * | 4/2012 | Burress et al. | 206/462 |
| 8,151,989 | B2 * | 4/2012 | Appelabaum et al. | 206/463 |
| 8,261,909 | B2 * | 9/2012 | Sorrentino et al. | 206/362.4 |
| 2001/0007308 | A1 * | 7/2001 | Glassman | 206/469 |
| 2004/0163990 | A1 | 8/2004 | Begim | |
| 2005/0218028 | A1 * | 10/2005 | Vestal et al. | 206/471 |
| 2005/0269232 | A1 | 12/2005 | Eisenbraun | |
| 2006/0113215 | A1 | 6/2006 | Clements et al. | |
| 2007/0029223 | A1 * | 2/2007 | Mazurek | 206/463 |
| 2007/0125678 | A1 | 6/2007 | Green | |
| 2008/0029417 | A1 | 2/2008 | Begim | |
| 2008/0217199 | A1 * | 9/2008 | Burress et al. | 206/470 |
| 2008/0237081 | A1 | 10/2008 | Wade | |
| 2008/0245694 | A1 | 10/2008 | Shibata et al. | |
| 2010/0072093 | A1 * | 3/2010 | Cross | 206/349 |
| 2010/0181222 | A1 | 7/2010 | Aiko et al. | |
| 2010/0236963 | A1 | 9/2010 | Nazari | |
| 2012/0061272 | A1 * | 3/2012 | Wagner | 206/320 |

* cited by examiner

CLAMSHELL PACKAGING

CROSS-REFERENCE TO RELATED APPLICATIONS

This application claims priority to U.S. Provisional Patent Application No. 61/653,868, filed May 31, 2012, the entire contents of which are incorporated by reference herein.

BACKGROUND

The present invention relates to product packaging, more specifically, to clamshell-type packaging.

Clamshell packaging is used, for example, at a point-of-purchase for the display of merchandise. Clamshell packaging allows for irregularly shaped items to be hung from hooks or pegs at the point-of-purchase. In some cases, translucent portions of the packaging allow the item to be viewed within the clamshell packaging.

SUMMARY

In one embodiment, the invention provides a clamshell package. A first clamshell portion has a first surface with a first edge, and a first chamber portion. A second clamshell portion is coupled to the first clamshell portion about a fold axis. The second clamshell portion has a second surface with a second edge, and a second chamber portion. A paper card includes a first card portion, a second card portion, and a connecting portion connecting the first card portion and the second card portion. The first card portion is coupled to the first surface. The second portion is coupled to the second surface. The first edge and second edge extend beyond a perimeter of the paper card. A hanging hole extends through the first clamshell portion, the second clamshell portion, and the paper card.

In another embodiment the invention provides a method of assembling a clamshell package. A plastic shell is provided. A first chamber is formed in a first clamshell portion of the plastic shell. A second chamber is formed in a second clamshell portion of the plastic shell. The plastic shell is folded about a fold axis disposed between the first clamshell portion and the second clamshell portion. The first clamshell portion is welded to the second clamshell portion. A paper card is provided. A chamber aperture is formed in the card for receiving at least one of the first chamber and the second chamber. The paper card is folded about the plastic shell. The paper card is coupled to the first clamshell portion and the second clamshell portion, such that edges of the first clamshell portion and second clamshell portion extend beyond a perimeter of the paper card. A hanger hole is formed through the first clamshell portion, the second clamshell portion, and the paper card.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
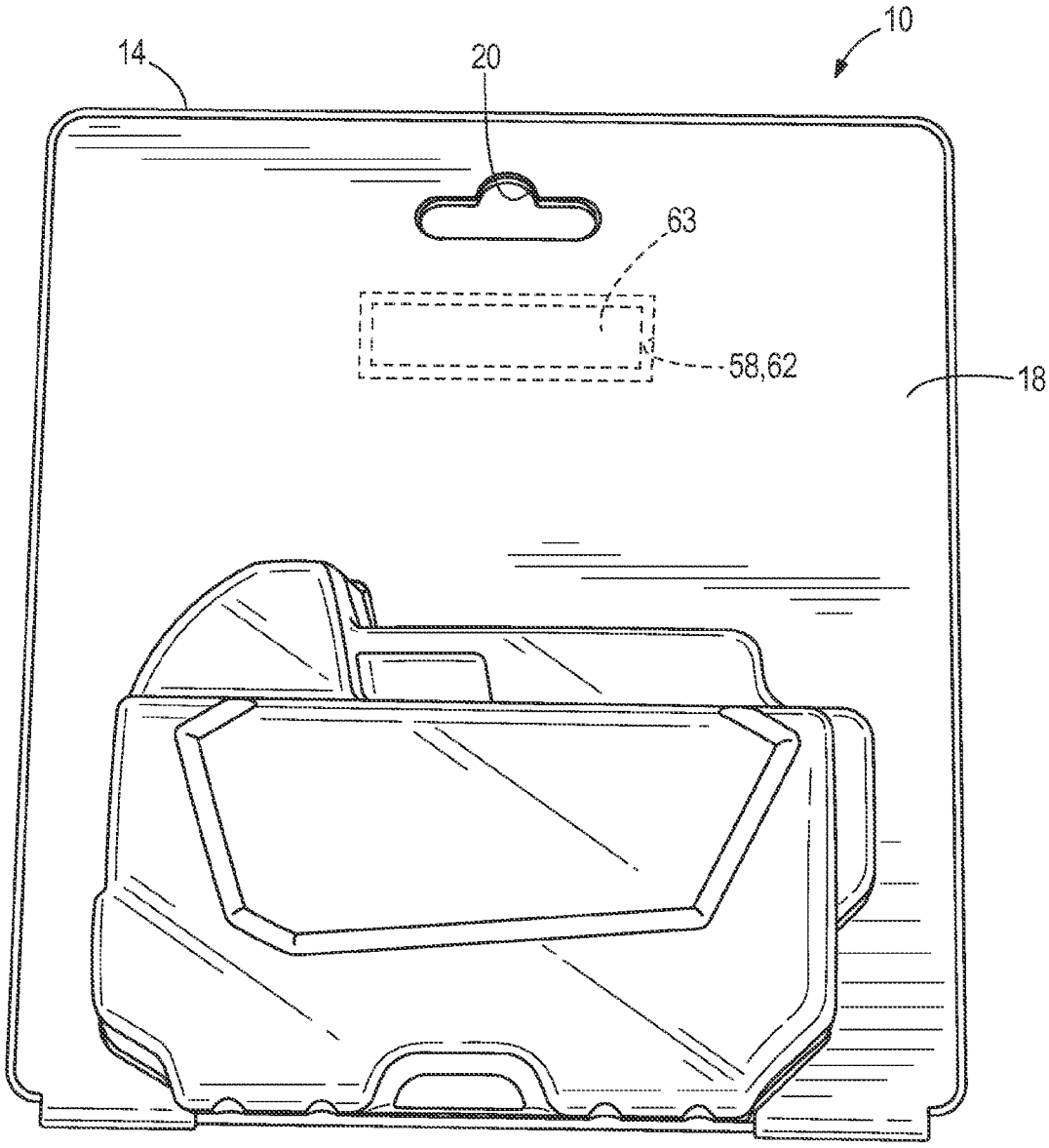
FIG. 1 is a front view of a clamshell package according to one embodiment of the invention.
Figure 2:
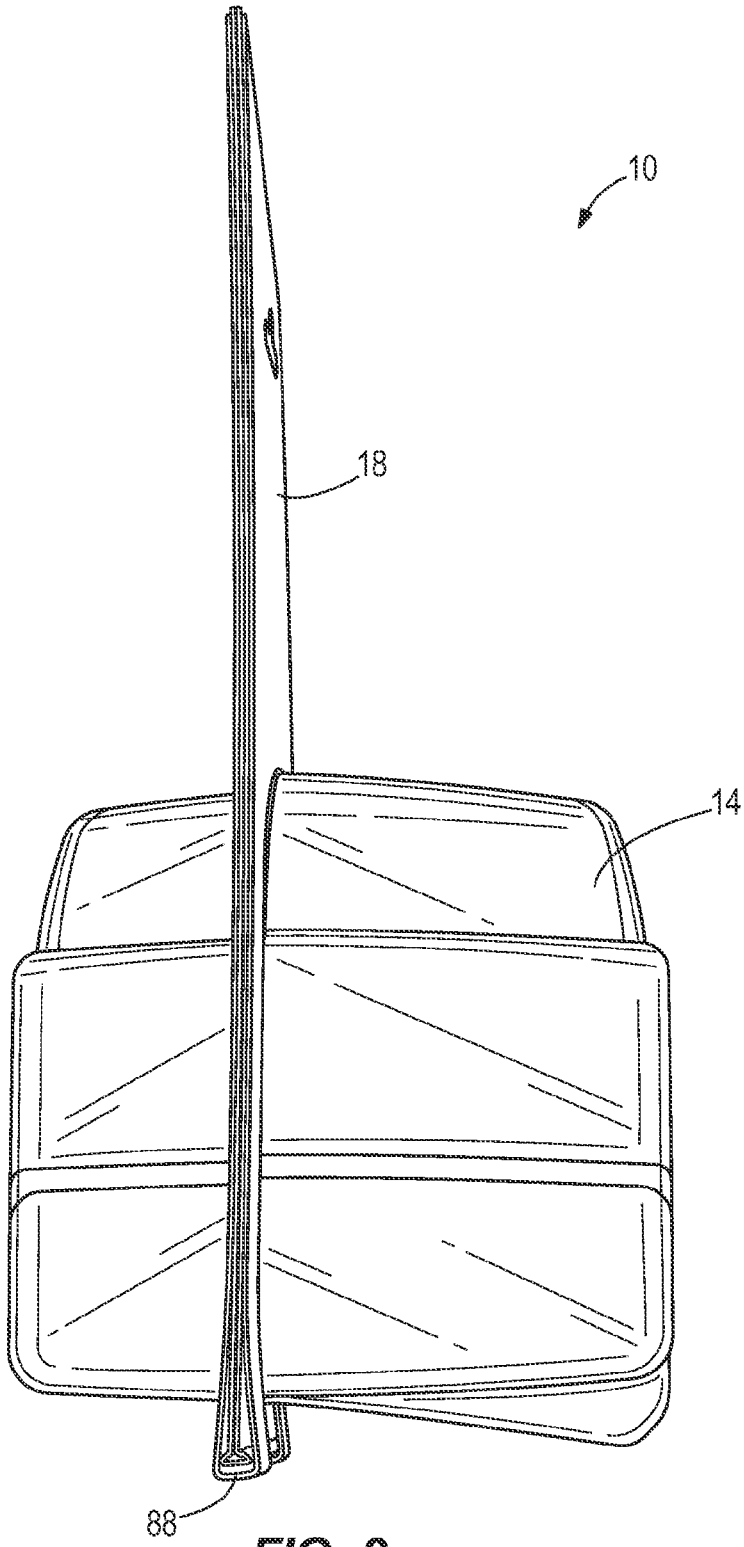
FIG. 2 is a side view of the clamshell package of FIG. 1.

Referring to FIGS. 1 and 2, a clamshell package 10 includes a plastic shell 14 and a paper card 18. The plastic shell 14 is configured to receive a product (not shown). The paper card 18 folds in half around the plastic shell 14 to partially conceal the plastic shell 14. Referring to FIG. 1, a hanging hole 20 extends through the paper card 18 and the plastic shell 14 for hanging the clamshell package 10 from a hook or peg and displaying the product at a point of purchase display.

Figure 3:
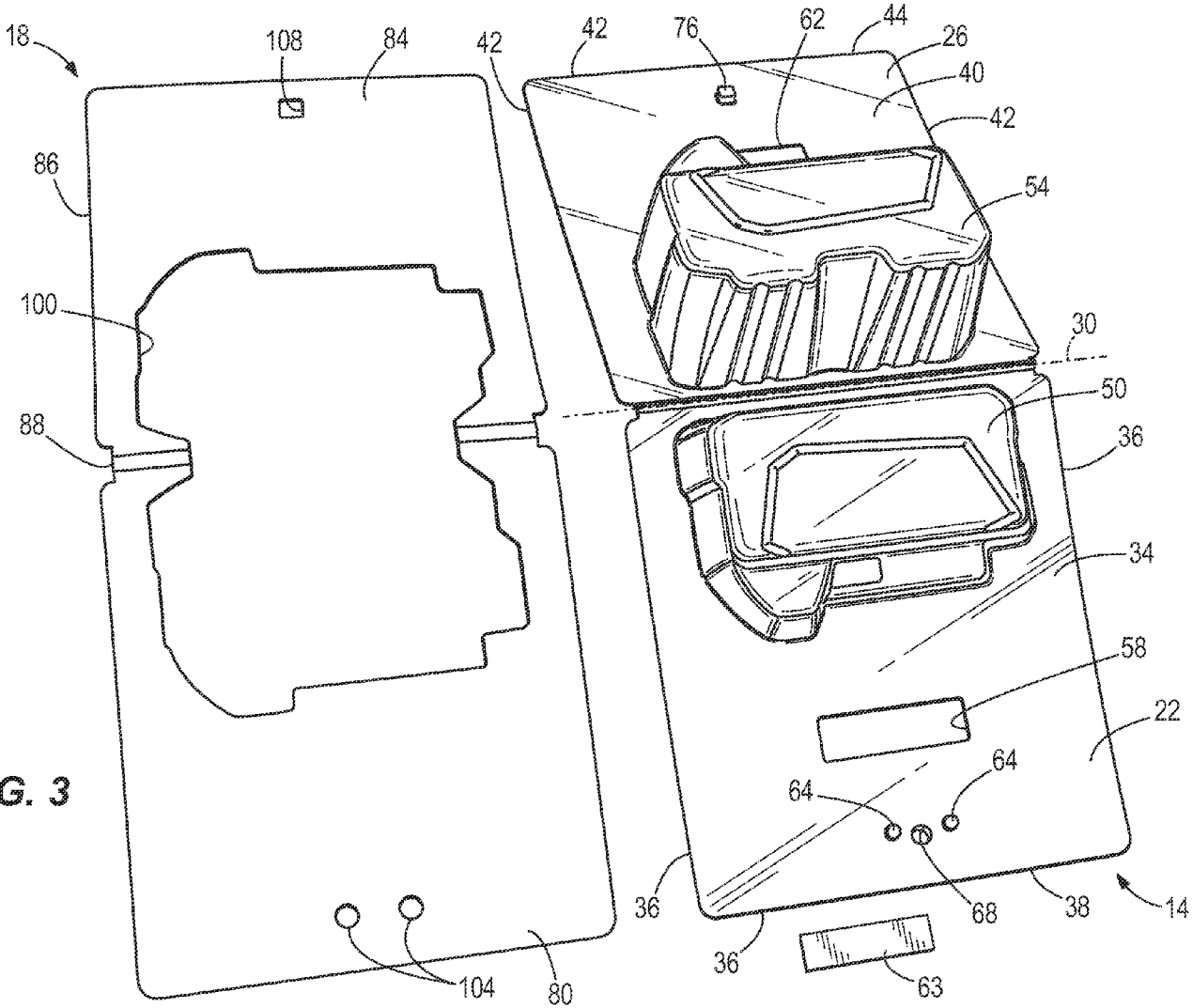
FIG. 3 is an exploded view of the clamshell package of FIG. 1.

Referring to FIG. 3, the transparent plastic shell 14 includes a first clamshell half 22 and a second clamshell half 26. The first clamshell half is pivotally coupled to the second clamshell half about a fold axis 30.

The first clamshell half 22 includes a first surface 34, with edges 36 defining a perimeter 38. The second clamshell half 26 includes a second surface 40 with edges 42 defining a perimeter 44. The first surface 34 surrounds a first chamber portion 50. The second surface 40 surrounds a second chamber portion 54. A first slot 58 is defined in the first surface. A second slot 62 is defined in the second surface. As illustrated in FIGS. 1 and 3, the first slot 58 and the second slot 62 are configured to accommodate a security tag 63.

Figure 4:
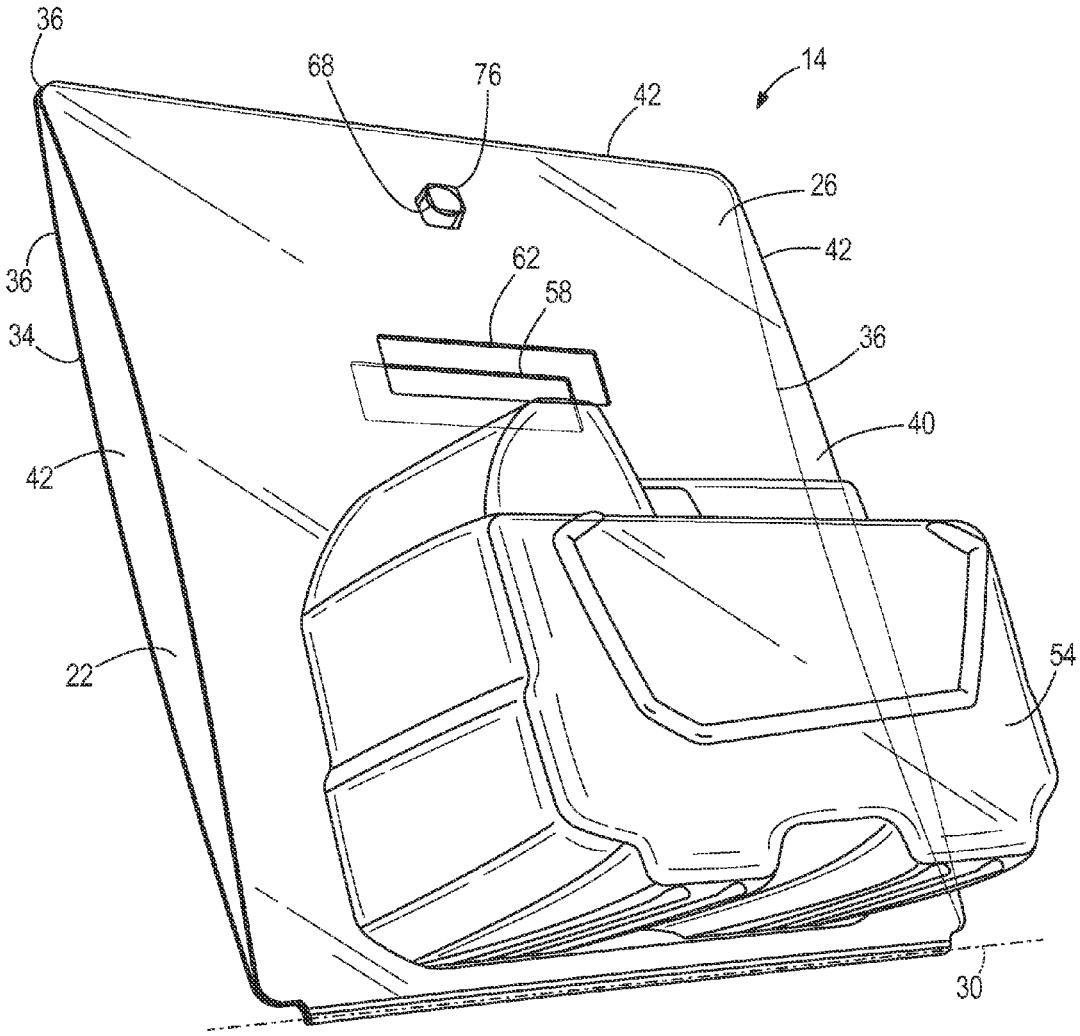
FIG. 4 is a perspective view of a plastic shell of the clamshell package of FIG. 1.

Referring to FIG. 3, a pair of alignment posts 64 project outwardly from the first surface 34. A first projection 68 projects inwardly from the first surface between the pair of alignment posts 64. A second projection 76 that extends outwardly from the second surface 40. Referring to FIG. 4, the second projection 76 is configured to receive the first projection 68 when the plastic shell 14 is folded about the fold axis 30.

The plastic shell 14, including the first clamshell half 22 and the second clamshell half 26 may be formed, for example, by various combinations of blow molding, vacuum thermoforming, and die-cutting operations.

Referring to FIG. 3, the paper card 18 includes a first side 80 and a second side 84, with a perimeter 86. As also shown in FIG. 2, a foldable connecting portion 88 connects the first side 80 to the second side 84. Referring to FIG. 3, the paper card 18 defines a chamber aperture 100 that extends between the first side 80 and the second side 84 for receiving the first chamber 50 and the second chamber 54. The first side 80 includes a pair of alignment holes 104 that are configured to receive the pair of alignment posts 64 for alignment purposes. The second side 84 includes an alignment hole 108 that is configured to receive the second projection 76 for alignment purposes. The paper card 18 may be formed, for example, by die-cutting operations.

Referring to FIG. 4, the plastic shell 14 is assembled as follows. The security tag 63 (FIG. 1) may be placed within the first slot 58 and the second slot 62 and secured between the first clamshell half 22 and the second clamshell half 26 by application to the paper card 18 on either the reverse of side 80 and the reverse of side 84. A product, such as a power tool accessory or battery, is placed within either the first chamber portion 50 (FIG. 3) or the second chamber portion 54. In other embodiments, the chamber portions may be divided and configured to receive multiple products and products of various geometries.

Referring to FIG. 4, the first clamshell half 22 and the second clamshell half 26 are folded about the fold axis 30 such that the product is encapsulated between the first chamber 50 and the second chamber 54 and the first surface 34 and the second surface 40 are temporarily exposed. The second projection 76 receives the first projection 68 to align and secure the first clamshell 22 with the second clamshell 26. Edges 36 are heat-welded to edges 42 using an impulse sealer, ultrasonic waves, or an equivalent method of heat-welding to at least partially seal the product within the plastic shell 14.

Figure 5:
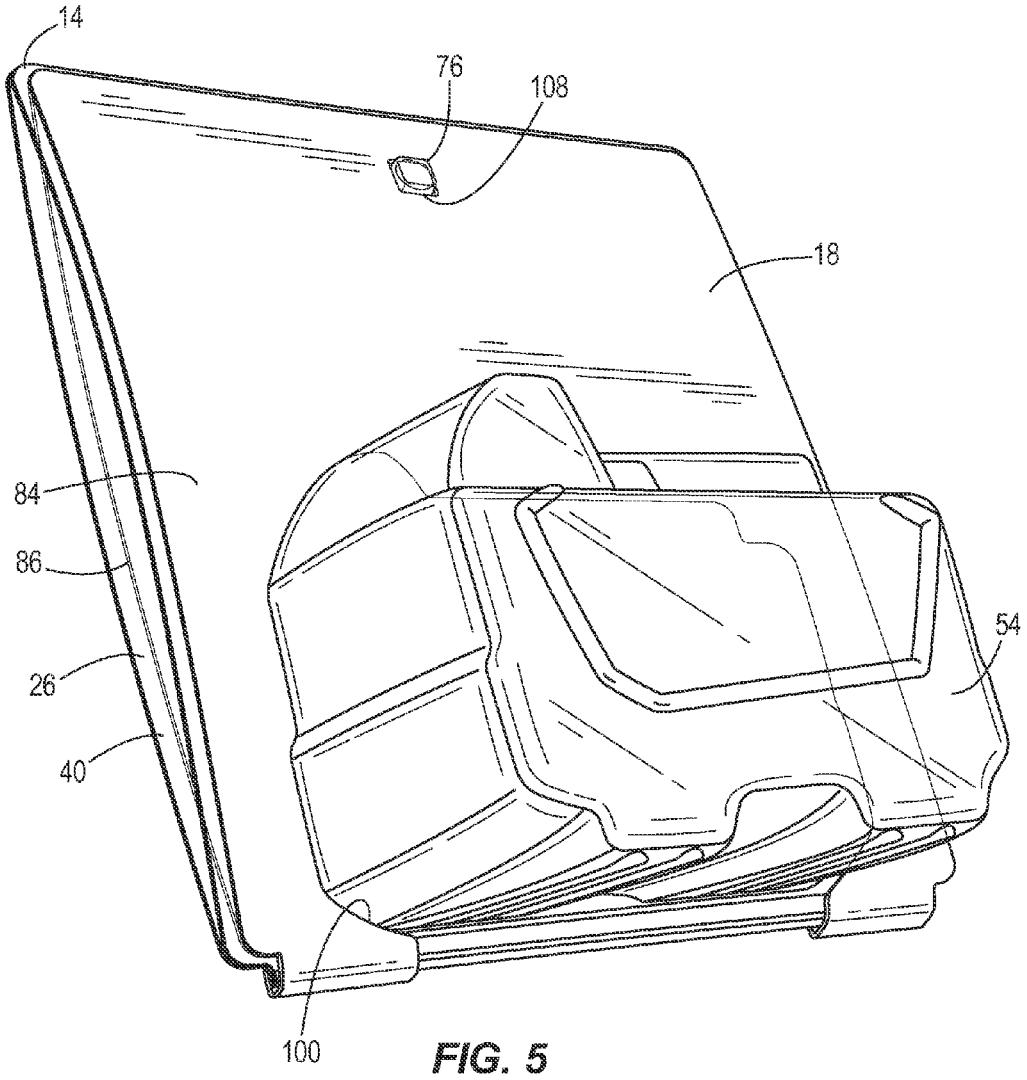
FIG. 5 is a perspective view of the clamshell package of FIG. 1.

With reference to FIG. 5, the die-cut paper card 18 is folded over the plastic shell 14 such that the first chamber 50 (not shown) and the second chamber 54 are received in the aperture 100. An adhesive material is applied between the plastic shell 14 and the paper card 18 to secure the paper card 18 to the first surface 34 (not shown) and the second surface 40 of the plastic shell 14. The adhesive material is preferably applied between the plastic shell 14 and the paper card 18 after the plastic shell 14 has been heat-welded, but it may also be applied prior to the heat-welding operation. The pair of holes 104 receives the alignment posts 64 (FIG. 3) to align the first side 80 with the first clamshell half 22. As shown in FIG. 5, the hole 108 receives the second projection 76 to align the second side 84 with the second clamshell half 26. As illustrated in FIG. 1, the paper card 18 conceals the security tag such that the security tag is hidden from view. As assembled, the plastic shell 14 extends beyond the perimeter 86 of the card 18 to protect the card 18 from damage.

The pair of holes 104, the alignment posts 64, and the second projection 76 (FIG. 3) are punched out to form the hanging hole 20 (FIG. 1). The hanging hole 20 extends through the paper card 18 and the plastic shell 14 such that the package 10 can be hung for display.

Although the invention has been described with reference to certain preferred embodiments, variations and modifications exist within the scope and spirit of one or more independent aspects of the invention as described. Accordingly, the invention is not to be restricted except in light of the attached claims and their equivalents.

Thus, the invention provides, among other things, a clamshell package. Various features and advantages of the invention are set forth in the following claims.

What is claimed is:

1. a clamshell package comprising:

a first clamshell portion having a first outer surface with a first edge, and a first chamber portion;

a second clamshell portion coupled to the first clamshell portion about a fold axis, the second clamshell portion having a second outer surface with a second edge, and a second chamber portion; and a paper card including a first card portion, a second card portion, and a connecting portion connecting the first card portion and the second card portion, the first card portion coupled to the first outer surface to substantially cover the first outer surface, the second portion coupled to the second outer surface to substantially cover the second outer surface, the first edge of the first clamshell portion and the second edge of the second clamshell portion extending beyond a perimeter of the paper card, wherein a hanging hole extends through the first clamshell portion, the second clamshell portion, and the paper card.

2. The clamshell package of claim 1, wherein the paper card is adhesively coupled to at least one of the first outer surface and the second outer surface.

3. The clamshell package of claim 1, wherein the first clamshell portion is substantially transparent.

4. The clamshell package of claim 1, wherein the first chamber portion and second chamber portion are each substantially transparent.

5. The clamshell package of claim 1, wherein the first clamshell portion and second clamshell portion are unitarily formed as one piece.

6. The clamshell package of claim 1, wherein the first clamshell portion defines a slot for receiving a security tag.

7. The clamshell package of claim 6, wherein the slot is covered by the first portion of the paper card.

8. The clamshell package of claim 1, wherein the paper card defines an aperture at least partially surrounding the first chamber.

9. The clamshell package of claim 1, wherein the paper card defines an aperture that receives the first chamber and the second chamber.

10. The clamshell package of claim 1, wherein the hanging hole extends through the first card portion and the second card portion.

11. A method of assembling a clamshell package, comprising:

providing a plastic shell;

forming a first chamber in a first clamshell portion of the plastic shell, the first clamshell portion including a first outer surface;

forming a second chamber in a second clamshell portion of the plastic shell, the second clamshell portion including a second outer surface;

folding the plastic shell about a fold axis disposed between the first clamshell portion and the second clamshell portion;

welding the first clamshell portion to the second clamshell portion;

providing a paper card;

forming a chamber aperture in the card for receiving at least one of the first chamber and the second chamber;

folding the paper card about the plastic shell;

coupling the paper card to the first outer surface and the second outer surface to substantially cover the first outer surface and the second outer surface, such that edges of the first clamshell portion and second clamshell portion extend beyond a perimeter of the paper card; and forming a hanger hole through the first clamshell portion, the second clamshell portion, and the paper card.

12. The method of claim 11, further comprising:

forming an alignment post in the first clamshell portion;

forming an alignment hole in the paper card; and positioning the paper card on the first clamshell portion with the alignment post extending through the alignment hole.

13. The method of claim 12, wherein forming the hanger hole includes punching out the alignment post and alignment hole.

14. The method of claim 11, further comprising:

forming a first projection in the first clamshell portion;

forming a second projection in the second clamshell portion; and receiving the first projection within the second projection.

15. The method of claim 14, wherein forming the hanger hole includes punching out the first projection and the second projection.

16. The method of claim 11, further comprising:

applying an adhesive between the plastic shell and the paper card; and adhesively securing the paper card to the plastic shell.

17. The method of claim 11, further comprising:

forming a slot in at least one of the first clamshell portion and the second clamshell portion; and placing a security tag in the slot.

18. The method of claim 17, further comprising covering the security tag with the paper card.

19. The method of claim 11, wherein forming the first chamber includes vacuum thermoforming.

20. The method of claim 11, wherein forming the chamber aperture includes die cutting.

* * * * *